US010249482B2

(12) United States Patent
Kalinina et al.

(10) Patent No.: US 10,249,482 B2
(45) Date of Patent: Apr. 2, 2019

(54) TIME OF FLIGHT MASS SPECTROMETER

(71) Applicant: KRATOS ANALYTICAL LIMITED, Manchester, Greater Manchester (GB)

(72) Inventors: Diana Kalinina, Manchester (GB); John Allison, Manchester (GB); Caroline Breen, Manchester (GB)

(73) Assignee: KRATOS ANALYTICAL LIMITED, Manchester, Greater Manchester (GB)

( * ) Notice: Subject to any disclaimer, the term of this patent is extended or adjusted under 35 U.S.C. 154(b) by 9 days.

(21) Appl. No.: 15/538,339

(22) PCT Filed: Nov. 26, 2015

(86) PCT No.: PCT/EP2015/077828
§ 371 (c)(1),
(2) Date: Jun. 21, 2017

(87) PCT Pub. No.: WO2016/102140
PCT Pub. Date: Jun. 30, 2016

(65) Prior Publication Data

US 2017/0352527 A1 Dec. 7, 2017

(30) Foreign Application Priority Data

Dec. 23, 2014 (GB) ..... 1423068.4

(51) Int. Cl.
*H01J 49/04* (2006.01)
*H01J 49/06* (2006.01)
(Continued)

(52) U.S. Cl.
CPC ..... *H01J 49/0418* (2013.01); *H01J 49/06* (2013.01); *H01J 49/403* (2013.01); *H01J 49/164* (2013.01); *H01J 49/40* (2013.01)

(58) Field of Classification Search
CPC ..... H01J 49/0418; H01J 49/06; H01J 49/403; H01J 49/164; H01J 49/40
(Continued)

(56) References Cited

U.S. PATENT DOCUMENTS 6,888,129 B2 5/2005 Bowdler et al.
2002/0036262 A1 11/2002 Bowdler et al.
(Continued)

OTHER PUBLICATIONS

International Search Report for PCT/EP2015/077828 dated Feb. 17, 2016 [PCT/ISA/210].
(Continued)

*Primary Examiner* — Nicole M Ippolito
(74) *Attorney, Agent, or Firm* — Sughrue Mion, PLLC

(57) ABSTRACT

A time of flight mass spectrometer that includes a first electrode; and a second electrode that is spaced apart from the first electrode. The ion source is configured to apply voltages to the first and second electrodes to produce an electric field in a region between the first and second electrodes so as to influence ions present in the region between the first and second electrodes when the mass spectrometer is in use. A shield is formed on the first electrode and/or second electrode. The shield is configured to inhibit an electric field formed between edges of the first and second electrodes from penetrating into the region between the first and second electrodes when the mass spectrometer is in use.

10 Claims, 8 Drawing Sheets

(51) Int. Cl.
*H01J 49/40* (2006.01)
*H01J 49/16* (2006.01)

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 2004/0089802 | A1* | 5/2004 | Kato ..... | H01J 49/107<br>250/285 |
| 2006/0255289 | A1 | 11/2006 | Cygan et al. | |
| 2008/0029696 | A1 | 2/2008 | Li | |
| 2008/0272286 | A1 | 11/2008 | Vestal | |
| 2010/0224774 | A1 | 9/2010 | Griep-Raming et al. | |
| 2011/0186730 | A1 | 8/2011 | Bisling | |

OTHER PUBLICATIONS

Written Opinion for PCT/EP2015/077828 dated Feb. 17, 2016 [PCT/ISA/237].
United Kingdom Search Report for GB1423068.4 dated Jul. 27, 2015.

* cited by examiner

TIME OF FLIGHT MASS SPECTROMETER

CROSS REFERENCE TO RELATED APPLICATIONS

This application is a National Stage of International Application No. PCT/EP2015/077828 filed Nov. 26, 2015, claiming priority based on United Kingdom Patent Application No. 1423068.4 filed Dec. 23, 2014, the contents of all of which are incorporated herein by reference in their entirety.

This invention relates to a time of flight ("TOF") mass spectrometer.

As discussed in more detail below, in a typical MALDI ion source for a TOF mass spectrometer, ions are produced from a small area on a sample plate, which area is typically no larger than the size of the beam waist of irradiating laser light, typically 5 μm to 500 μm in diameter. In most practical applications, it is required to analyse ions from several points on the same sample plate that may extend over several cm, or from several smaller samples arranged over an area of several cm. Typically the samples are arranged on a sample plate of rectangular form that may have a width that is in the range 20 mm to 150 mm (though other widths and forms are possible). It is possible to scan the laser beam (which may be UV light) over a stationary sample plate or move the sample plate relative to a fixed laser position. For most applications, it is more practical to translate the sample plate in a plane perpendicular to an ion optic axis. This is usually achieved by mounting the sample plate on a sample plate carrier, using a mechanism configured to translate the sample plate carrier laterally (e.g. in two orthogonal directions within a plane perpendicular to the ion optic axis).

As discussed in more detail below with reference to FIG. 8, the inventors have found that, in some configurations of ion source, the amplitude of a mass spectrum obtained from a sample located in a corner or side/edge of a sample plate can suffer a significant drop of intensity compared with a mass spectrum obtained from a sample located in the centre of a sample plate. As discussed in more detail below, the inventors believe this drop of intensity may be caused by side field penetration into an extraction region formed between first and second electrodes in the ion source.

The present invention has been devised in light of the above considerations.

U.S. Pat. No. 6,888,129, discussed in more detail below, provides a lens for a TOF mass spectrometer ion source, said lens including an element having an aperture, said aperture extending through the element so as to form a through channel, such that, in use, ions may pass from one side of the element to the opposite side of the element by passing through said through channel.

At its most general, a first aspect of the invention may provide:

A time of flight mass spectrometer including:

a first electrode; and a second electrode that is spaced apart from the first electrode;

wherein the ion source is configured to apply voltages to the first and second electrodes to produce an electric field in a region between the first and second electrodes so as to influence ions present in the region between the first and second electrodes when the mass spectrometer is in use;

wherein a shield is formed on the first electrode and/or second electrode, wherein the shield is configured to inhibit an electric field formed between edges of the first and second electrodes from penetrating into the region between the first and second electrodes when the mass spectrometer is in use.

The inhibited electric field formed between edges of the first and second electrodes may have the form of electric field edge effects, which are inhibited by the shield from penetrating into the region between the first and second electrodes in a radial direction, relative to an axis extending between the first and second electrodes. The region between the first and second electrodes (from which the electric field formed between edges of the first and second electrodes is inhibited from penetrating into) may have an outer boundary (relative to an axis extending between the first and second electrodes) defined by a limit of where ions formed by the mass spectrometer are able to reach when the mass spectrometer is in use.

Thus, the shield may be viewed as helping to inhibit (preferably substantially prevent) any fringing electric field that is naturally formed by two overlapping electrodes of finite length from penetrating into the region formed between the first and second electrodes.

An electric field formed between edges of the first and second electrodes may be referred to herein as a "side field". As discussed below with reference to FIG. 8 and FIG. 9, side field penetration into a region between first and second electrodes can, through deflection of ions from desirable trajectories, cause a loss of intensity and/or mass shift in mass spectra produced by the TOF mass spectrometer, particularly if the first and second electrodes are laterally offset from each other, e.g. as may be the case for the first and second electrodes belonging to a MALDI/SALDI ion source. Thus, by inhibiting (preferably substantially preventing) such a field, the shield can help to avoid a loss of intensity in mass spectra produced by the TOF mass spectrometer.

A shield as proposed in the first aspect of this invention is distinguished from the "tube" 14 proposed in U.S. Pat. No. 6,888,129, since the "tube" 14 proposed in U.S. Pat. No. 6,888,129 is not configured to inhibit an electric field formed between edges of first and second electrodes from penetrating into the region between the first and second electrodes when the mass spectrometer is in use. Rather, the "tube" 14 proposed in U.S. Pat. No. 6,888,129 is configured to inhibit an electric field from penetrating into a region in front of a sample plate through an aperture in the "planar element" 13 (see e.g. col. 1 line 67 to col. 2 line 15 of U.S. Pat. No. 6,888,129) and therefore the electrodes of U.S. Pat. No. 6,888,129 are susceptible to side field penetration.

In the discussion below, various preferred forms/geometries/parameters for the shield as well as the first and second electrodes are discussed. These preferred forms/geometries/parameters may be defined with reference to any one or more of the following:

An axis extending between the first and second electrodes. This axis is preferably an ion optic axis, which may be defined as an axis along which ions travel when the mass spectrometer is in use. If the first and/or second electrode includes an aperture formed therein (see below), then the ion optic axis preferably extends through the aperture (preferably through the centre of the aperture).

An inwardly facing surface of the shield: this may be taken to be a surface of the shield which faces inwardly towards an axis extending between the first and second electrodes.

An outwardly facing surface of the shield: this may be taken to be a surface of the shield which faces outwardly away from an axis extending between the first and second electrodes.

The height of the shield: this may be taken to be a distance by which the shield extends from a surface of the electrode on which the shield is formed towards the other electrode.

The width of the aperture: if the first and/or second electrode includes an aperture formed therein (see below), the width of the aperture may be taken to be the distance across the aperture at its widest extent. If the aperture is circular, this may be taken to be the diameter of the aperture.

The width of the first and/or second electrode: this may be taken to be the distance across the first and/or second electrode at its widest extent.

An ion optic axis may serve an axis of rotational symmetry of the first and/or second electrode, an aperture formed in the first and/or second electrode (if an aperture is present) and/or the shield, e.g. as may be the case if these elements are circular.

If the shield is circular and an ion optic axis serves as an axis of rotational symmetry of the shield, the distance from the ion optic axis to the inwardly facing surface of the shield may be referred to as an "inner radius" of the shield. Similarly, the distance from the ion optic axis to the outwardly facing surface of the shield may be referred to as an "outer radius" of the shield.

Preferably, the shield is a raised element formed on a surface of one of the first and second electrodes that faces the other of the first and second electrodes so that the shield extends towards the other of the first and second electrodes.

Preferably, the shield surrounds (e.g. loops around) an axis extending between the first and second electrodes. Thus, the shield may have a circular (e.g. annular or ring-shaped) form, though other geometries (e.g. square, oval, or indeed any shape capable of surrounding an axis) are possible.

The first and/or second electrode may be a plate-shaped element. The first and/or second electrode may therefore have two generally planar opposing surfaces, though for completeness we note that this would not exclude the possibility of raised features being formed on the generally planar opposing surfaces of the first and/or second electrode (e.g. the shield or secondary shield described below). Non-planar surfaces are also possible.

The first and/or second electrode may include an aperture formed therein.

The width of an aperture formed in the first and/or second electrode is preferably in the range 2 mm to 20 mm. For the avoidance of any doubt, if both electrodes include an aperture formed therein, the apertures need not have the same width/diameter.

Preferably, the electrode on which the shield is formed includes an aperture formed therein. The width of such an aperture is preferably in the range 2 mm to 20 mm.

However, for the avoidance of any doubt, if only one of the first and second electrodes has an aperture formed therein, the shield may be formed on the electrode that does not have an aperture formed therein.

The first and second electrodes could be any electrode pair in a TOF mass spectrometer where voltages are applied to produce an electric field in a region between the first and second electrodes so as to influence (e.g. accelerate, decelerate, influence trajectory of, focus, defocus) ions present in the region between the first and second electrodes when the mass spectrometer is in use.

Parameters of the shield such as height, positions of outwardly and inwardly facing surfaces, could therefore be optimised, e.g. to achieve a desired electric field gradient for ions travelling along an ion optic axis.

Some pairs, or series, of electrodes in TOF mass spectrometers, such as found in reflectron analysers, have large outer diameters for the purpose of minimising side field penetration between the electrodes. The implementation of the shield proposed herein on each such pair of electrodes would allow the outer diameter of such an electrodes to be significantly reduced, with the shield helping to prevent the side field penetration that previously required a large diameter of reflectron electrode. Appropriate design of the shield to control ion lens formation may also allow the function of an electrode to be achieved with lower applied voltages.

The geometry of the shield may vary considerably depending on the geometry of other components in the mass spectrometer, particularly the geometry of the first and second electrodes, which will vary depending on their purpose. Thus, the shield may have different cross-sections (e.g. square, hump etc) and may form different shapes (e.g. circular, oval, square, etc) on a surface of the electrode on which it is formed, depending on the geometry of other components in the mass spectrometer.

In practice, the geometry of the shield may be optimised empirically, e.g. by running simulations whilst varying the geometry of the shield (and optionally varying the geometry of other components in the mass spectrometer) to obtain a desired effect.

Preferably, an inwardly facing surface of the shield is outwardly spaced apart from an axis extending between the first and second electrodes by a distance that is large enough to allow an intermediate portion of the electrode on which the shield is formed (i.e. a portion of the electrode that is within the inwardly facing surface of the shield) to be shaped according to ion optic requirements (e.g. so as to control extraction lensing, if the electrode on which the shield is formed is an extraction electrode).

To this end, an inwardly facing surface of the shield may be outwardly spaced apart from an axis extending between the first and second electrodes by a distance that is at least the width of an aperture formed in the first and/or second electrode. If the aperture and shield are circular, then this would equate to the inner radius of the shield being at least twice the radius of the aperture.

Likewise, if an aperture is formed in the electrode on which the shield is formed, then an inwardly facing surface of the shield is preferably outwardly spaced apart from a boundary between the electrode and the aperture formed in the electrode by a distance that is at least half of the width of the aperture. If the aperture and shield are circular, then this too would equate to the inner radius of the shield being at least twice the radius of the aperture.

The boundary between the electrode on which the shield is formed and an aperture formed in that electrode may be taken as the boundary where the electrode on which the shield is formed meets the aperture. If the shield is outwardly spaced apart from this boundary, there must be an intermediate portion of the electrode that is within the inwardly facing surface of the shield, and which can thus be shaped according to ion optic requirements.

A skilled person will nonetheless appreciate that it is not essential for an inwardly facing surface of the shield to be outwardly spaced apart from a boundary between the electrode on which the shield is formed and an aperture formed in that electrode, provided an outwardly facing surface of the shield is adequately spaced apart from the boundary to effectively inhibit an electric field formed between edges of the first and second electrodes from penetrating into the region between the first and second electrodes when the mass spectrometer is in use (see below).

Thus, an inwardly facing surface of the shield may be located at a boundary between the electrode on which the shield is formed and an aperture formed in that electrode, provided an outwardly facing surface of the shield is adequately spaced apart from the boundary between the electrode and the aperture to effectively inhibit an electric field formed between edges of the first and second electrodes from penetrating into the region between the first and second electrodes when the mass spectrometer is in use. In this context, it is noted that the outwardly facing surface of the "tube" 14 proposed in U.S. Pat. No. 6,888,129 is too close to a boundary between the "planar element" 13 and the aperture in the "planar element" 13 to be effective in inhibiting side field penetration.

To effectively inhibit an electric field formed between edges of the first and second electrodes from penetrating into the region between the first and second electrodes when the mass spectrometer is in use, an outwardly facing surface of the shield may be outwardly spaced apart from an axis extending between the first and second electrodes (e.g. an ion optic axis) by at least double the furthest distance relative to the axis that ions formed by the mass spectrometer can reach in the region between the first and second electrodes when the mass spectrometer is in use. This is normally straightforward to calculate for a given mass spectrometer. For example, if the first and second electrodes are included in an ion source of the mass spectrometer that implements pulsed extraction (see below), the furthest distance ions formed by the mass spectrometer may be determined according to a known predetermined period of time between ions being formed and an extraction electric field being produced, and a known maximum velocity of ions formed by the ion source (since this does not usually exceed 1500 $ms^{-1}$).

If the shield is circular (see above), a minimum value $Ro_{min}$ for an outer radius of the shield may be defined by the following equation:

$$Ro_{min}=G-hs+hc+Ri-w_{min}$$

Where G is a distance between the first and second electrodes, hs is the height of a secondary shield formed on the electrode on which the shield is formed (see below), hc is a minimum clearance between the shield and an electrode facing the shield to avoid breakdown between the first and second electrodes (e.g. for a given maximum potential difference to be applied between the first and second electrodes), Ri is an inner radius of the shield, and $w_{min}$ is a minimum width of the shield that is recommended practically for production. For example $w_{min}$ for a shield having a height of 20 mm might be 2 mm, $w_{min}$ for a shield having a height of 10 mm might be 1.1 mm.

In most cases, $w_{min}$ will be at least 1 mm.

In the case where parameters are non-symmetrical calculations using the above equation could be performed using an average value for each parameter. For example, for an oval shield, the equation could be repeated for both the longest extent and shortest extent of the shield.

Taking account of the above considerations, for most geometries, an outwardly facing surface of the shield may be outwardly spaced apart from an axis extending between the first and second electrodes by a distance that is at least 1.5 times the width of an aperture formed in the first and/or second electrode. If the aperture and shield are circular, then this would equate to the outer radius of the shield being at least three times the radius of the aperture.

Likewise, if an aperture is formed in the electrode on which the shield is formed, then an outwardly facing surface of the shield is preferably outwardly spaced from a boundary between the electrode on which the shield is formed and the aperture formed in the electrode by a distance that is at least the width of the aperture. If the aperture and shield are circular, then this would equate to the outer radius of the shield being at three times the radius of the aperture.

In some embodiments, an outwardly facing surface of the shield may be located coincident with an outer boundary of the electrode on which the shield is formed.

The shield may be any height deemed necessary to obtain the desired shielding effect, noting that in general, a wide low shield may in some situations have a similar effectiveness to a high narrow shield. However, this is not a strict rule, e.g. since for first and second electrode included in an ion source that implements pulsed extraction (see below), a wide low shield may have a similar effectiveness to a high narrow shield prior to the extraction electric field being produced, but once the extraction electric field is produced then different conditions are created (e.g. due to a lensing effect) that should be taken into account when determining the height of the shield.

Preferably, there is a minimum clearance between the shield and an electrode facing the shield of at least 2 mm, so as to avoid electrical breakdown between the first and second electrodes (since typically, the voltage between the first and second electrodes may reach 2 kV to 5 kV).

Preferably, the shield is formed on one of the first electrode or the second electrode. However, in some embodiments, the shield may comprise a first shield element formed on the first electrode and a second shield element formed on the second electrode. The first shield element and/or second shield element may be configured in the manner of a shield as described above with reference to a single electrode, and may have a combined height that is equal to a height of a shield as described above with reference to a single electrode.

Preferably, a secondary shield is formed on the electrode on which the shield is formed. The secondary shield is preferably configured to inhibit an electric field from penetrating into the region between the first and second electrodes through an aperture formed in the electrode on which the shield is formed. Note that the secondary shield would be in addition to the shield proposed above, so the shield proposed above may be referred to as the primary shield if both shields are present.

Preferably, the secondary shield is a raised element formed on the surface of the electrode on which the (primary) shield is formed so that the secondary shield extends towards the other electrode. Preferably, the secondary shield surrounds (e.g. loops around) an aperture formed in the electrode on which the shield is formed. Preferably, the secondary shield is located at a boundary between the electrode on which the shield is formed and an aperture formed in that electrode. The secondary shield may therefore have the form of a tube, e.g. similar to the "tube" 14 proposed in U.S. Pat. No. 6,888,129. Thus, the secondary shield may have the form of a hollow elongated member and the height of the secondary shield may be at least equal to 8/10 of the width (more preferably at least 9/10 of the width, or at least the width) of the aperture.

In relation to the secondary shield, it may be desirable to define the following parameter:

The height of the secondary shield: this may be taken to be the distance by which the secondary shield extends from a surface of the electrode on which the secondary shield is formed towards the other electrode.

If the secondary shield is present, the height of the (primary) shield is preferably larger than the height of the secondary shield. However, if the first and second electrodes are included in an ion source of the mass spectrometer that implements pulsed extraction (see below), a more important criteria to define is the height of the (primary) shield required to obtain a desired lensing effect in the extraction region after the extraction electric field is produced.

The first and/or second electrode may be circular, but again, other geometries are possible. If the electrode on which the shield is formed is circular, then the second electrode may have a radius in the range 20 mm to 100 mm.

Preferably, the first and second electrodes are included in an ion source of the mass spectrometer.

If the first and second electrodes are included in an ion source of the mass spectrometer, the ion source is preferably configured to apply voltages to the first and second electrodes to produce an extraction electric field in an extraction region between the first and second electrodes so as to extract ions from the extraction region through an aperture in the second electrode when the mass spectrometer is in use.

In this context, the second electrode may be referred to as an extraction electrode, in view of its role in extracting ions from the extraction region. The terms second electrode and extraction electrode may therefore be used interchangeably herein.

Thus, the first aspect of the invention may provide:

A time of flight mass spectrometer including an ion source, wherein the ion source includes:

a first electrode; and a second electrode that has an aperture formed therein and is spaced apart from the first electrode;

wherein the ion source is configured to apply voltages to the first and second electrodes to produce an extraction electric field in a region between the first and second electrodes so as to extract ions from the extraction region through the aperture in the second electrode when the mass spectrometer is in use;

wherein a shield is formed on the first electrode and/or second electrode, wherein the shield is configured to inhibit an electric field formed between edges of the first and second electrodes from penetrating into the region between the first and second electrodes when the mass spectrometer is in use.

If the first and second electrodes are included in an ion source of the mass spectrometer, the first electrode may be a sample plate for carrying a sample. The sample plate may be for carrying a plurality of samples arranged over an area of the sample plate. This area may extend over an area that is, for example, 2 cm or more in length.

The sample plate may be mounted on a sample plate carrier. If the sample plate carrier is conductive, then the first electrode may therefore additionally include the sample plate carrier.

The mass spectrometer may include a mechanism configured to translate the sample plate carrier (and therefore the sample plate) laterally with respect to an ion optic axis so as to laterally offset the sample plate carrier (and therefore the sample plate) with respect to the ion optic axis.

If the first and second electrodes are included in an ion source of the mass spectrometer with the second electrode having an aperture formed therein, the shield may conveniently be formed on the second electrode, but it would also be possible for the shield to be formed on the first electrode.

If the shield is formed on the second electrode, then preferably, an inwardly facing surface of the shield is outwardly spaced from a boundary between the second electrode and the aperture formed in the second electrode by a distance that is adequately small so that the inwardly facing surface of the shield remains within the outer boundary of the first electrode (which may include a sample plate and possibly also a sample plate carrier, see above) when viewed along an ion optic axis, when a centre of the sample plate carrier is at a maximum permitted lateral offset with respect to the ion optic axis. This spacing of the inwardly facing surface of the shield is preferred since if the inwardly facing surface were to be permitted to fall outside the outer boundary of the first electrode when viewed along the ion optic axis, then a side field may readily penetrate into the extraction region. The maximum permitted lateral offset (of the sample plate carrier with respect to the ion optic axis) may be determined by the maximum lateral offset at which a sample in an extreme analysis point on the sample plate lies in the ion optic axis.

Preferably, the ion source includes a laser for ionising a sample carried on the sample plate by firing light at the sample. Preferably, the laser is for ionising a sample by firing pulses of light at the sample material. The light produced by the laser is preferably UV light, though IR light is also possible.

However, the sample material may be ionised by other techniques.

The ion source may be configured to implement pulsed extraction, in which case the ion source may be configured to produce the extraction electric field a predetermined period of time (which may be 10 ns to 1 μs) after ions have been produced (e.g. by the laser). Before the extraction electric field is produced, the first and second electrode may be held at the same potential (e.g. this potential may be higher than 10 kV, e.g. ~20 kV). The predetermined period of time may be chosen for optimally focussing the kinetic energy spread of the ions that have been produced.

However, pulsed extraction is not a necessity since, in other embodiments, the ion source may be configured to produce a static extraction electric field that is present during both the formation and extraction of ions.

The ion source may be a MALDI (matrix-assisted laser desorption/ionisation) ion source. For a MALDI ion source, the sample material may include biomolecules (e.g. proteins), organic molecules and/or polymers. The sample material may be included in a (preferably crystalised) mixture of sample material and light absorbing matrix.

However, the ion source could be any ion source that has first and second electrodes configured as described above. For example, the ion source could also be a SALDI (surface-assisted laser desorption/ionisation) ion source, a laser desorption ion source that does not utilise a matrix, or a secondary ion mass spectrometry ("SIMS") ion source (that uses an ion beam instead of a laser) for example.

The mass spectrometer may include an ion detector for detecting ions produced by the ion source. The ion detector may form part of a mass analyser.

The first aspect of the invention may also provide an ion source as described above.

The first aspect of the invention may also provide a method of operating a time of flight mass spectrometer. The method may include any method step implementing or corresponding to a time of flight mass spectrometer described above.

The invention also includes any combination of the features described above except where such a combination is clearly impermissible or expressly avoided.

Examples of the present proposals are discussed below, with reference to the accompanying drawings in which.

Figure 2:
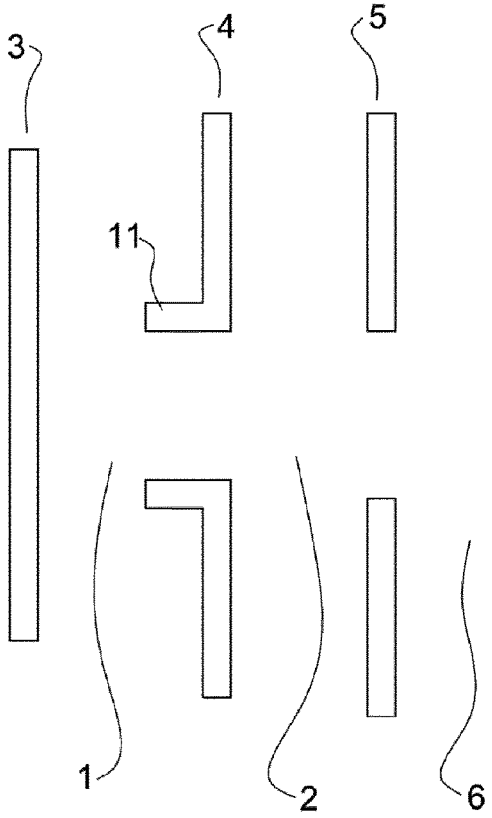
FIG. 2 shows another example TOF mass spectrometer that is not an embodiment of the present invention, but is useful for understanding the present invention.
Figure 3B:
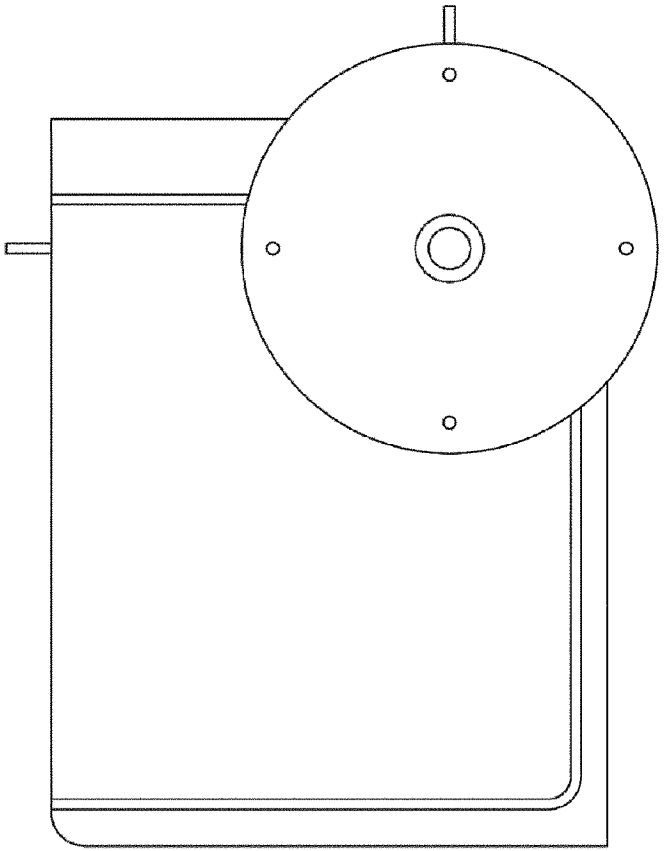
Figure 3A:
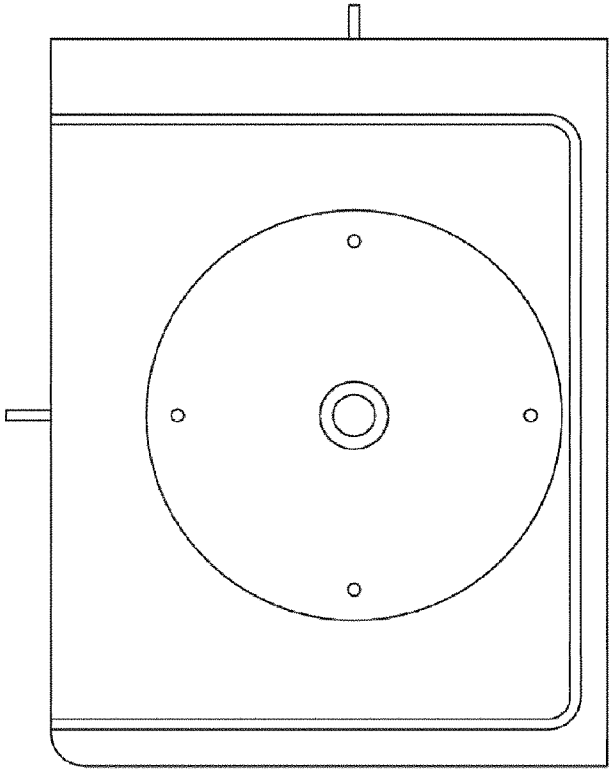

FIGS. 3(*a*) and 3(*b*) show a view along the ion optic axis of the extraction electrode and sample plate of the ion source of the TOF mass spectrometer of FIG. 2: FIG. 3(*a*) with the ion optic axis aligned with the centre of the sample plate and FIG. 3(*b*) with the ion optic axis aligned with an extreme analysis point on sample plate.

Figure 4A:
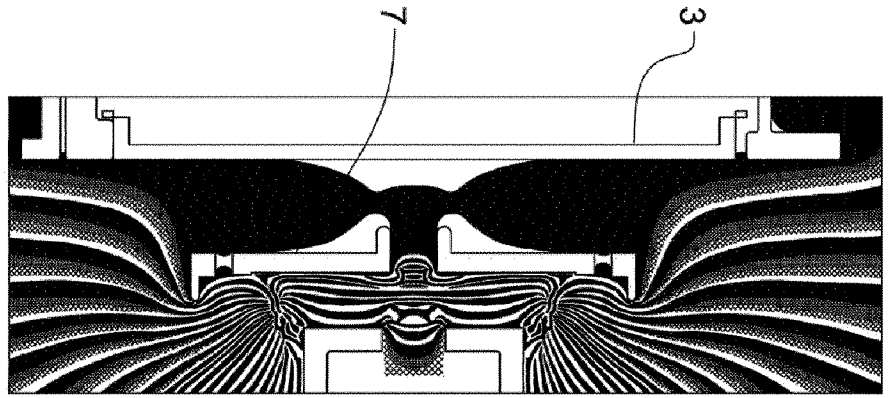
Figure 4B:
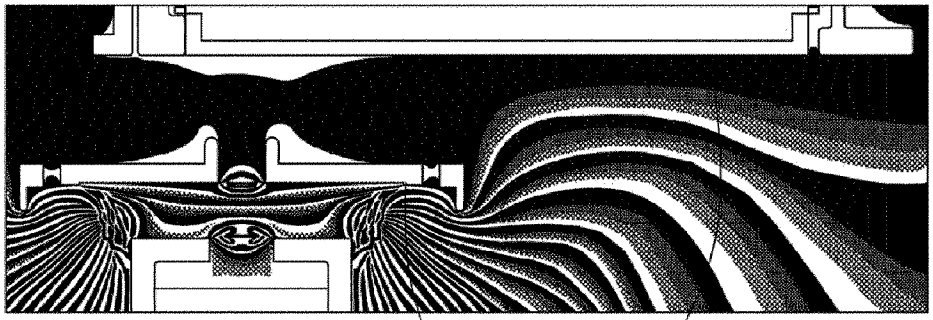

FIGS. 4(*a*) and 4(*b*) show cross-section views of electric field contours obtained from an electrostatic model of region around the sample plate and extraction electrode of the ion source of the TOF mass spectrometer of FIG. 2: FIG. 4(*a*) with the ion optic axis aligned with the centre of the sample plate and FIG. 4(*b*) with the ion optic axis aligned with an extreme analysis point on sample plate.

Figure 5A:
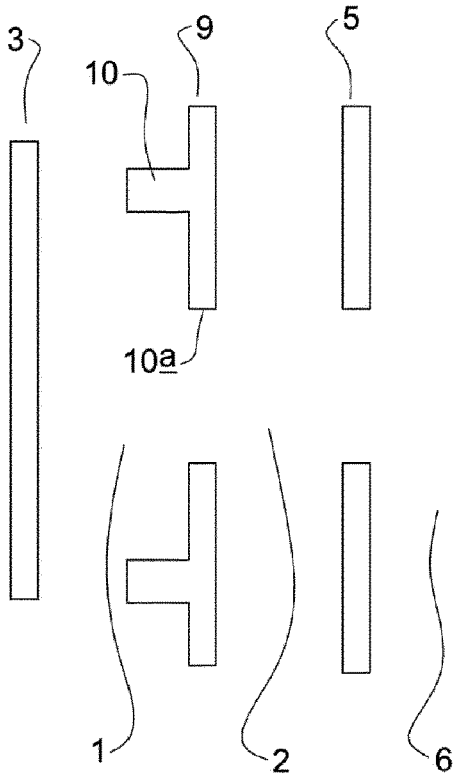
Figure 5B:
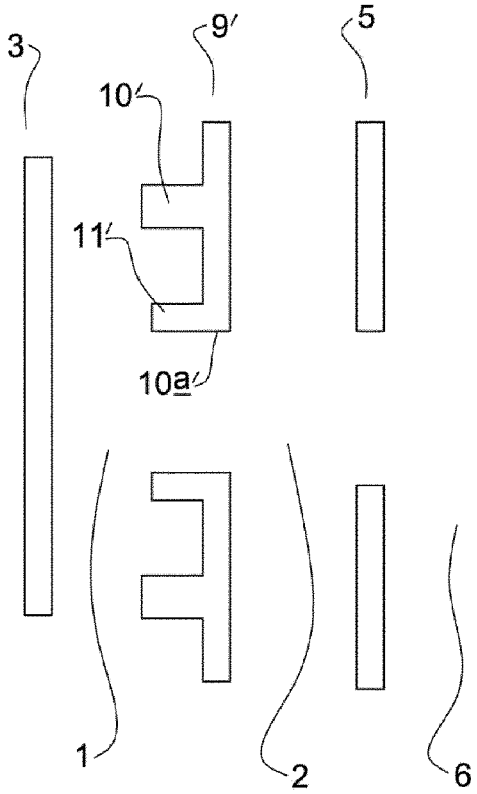

FIGS. 5(*a*) and 5(*b*) show an example TOF mass spectrometer whose ion source includes an extraction electrode having an annular shield formed thereon: FIG. 5(*a*) where the extraction electrode has a plane aperture (no secondary shield) and FIG. 5(*b*) where the extraction electrode has an aperture extending through the extraction electrode to form a through channel (with secondary shield).

Figure 6:
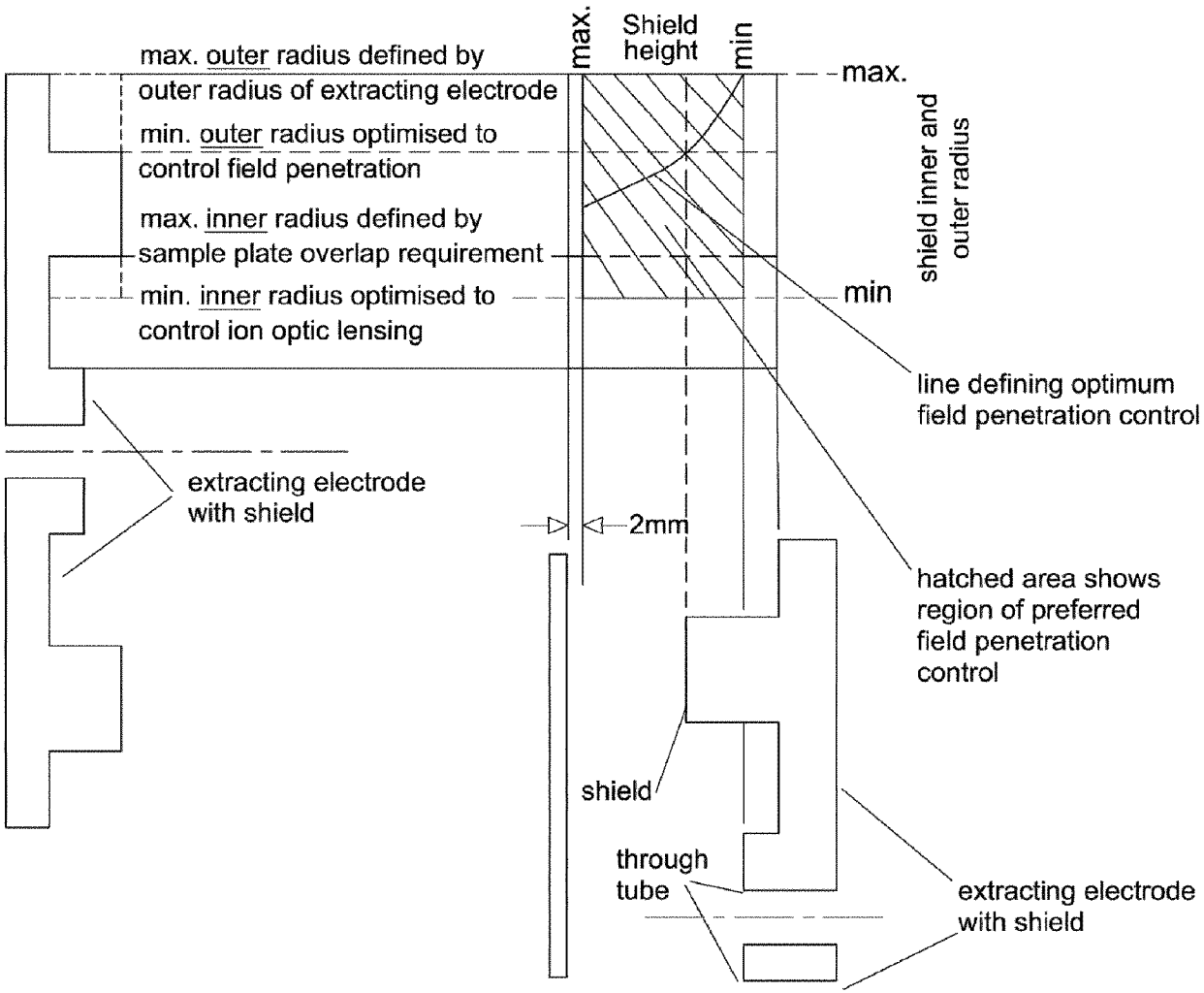

FIG. 6 shows preferred limits and values for parameters defining the shield of FIGS. 5(*a*) and 5(*b*).

Figure 7A:
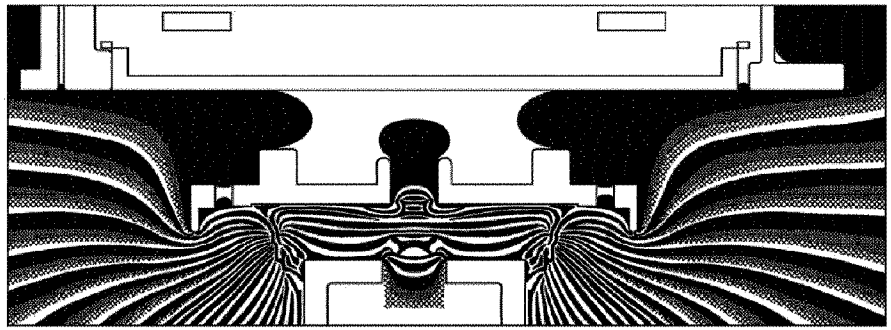
Figure 7B:
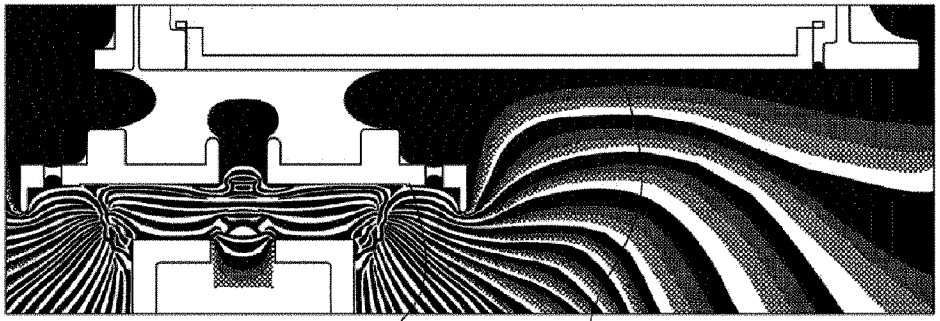

FIGS. 7(*a*) and 7(*b*) show cross-section views-of electric field contours obtained from an electrostatic model of region around the sample plate and extraction electrode of the ion source of FIG. 5(*b*): FIG. 7(*a*) with the ion optic axis aligned with the centre of the sample plate and FIG. 7(*b*) with the ion optic axis aligned with an extreme analysis point on sample plate.

Figure 8A:
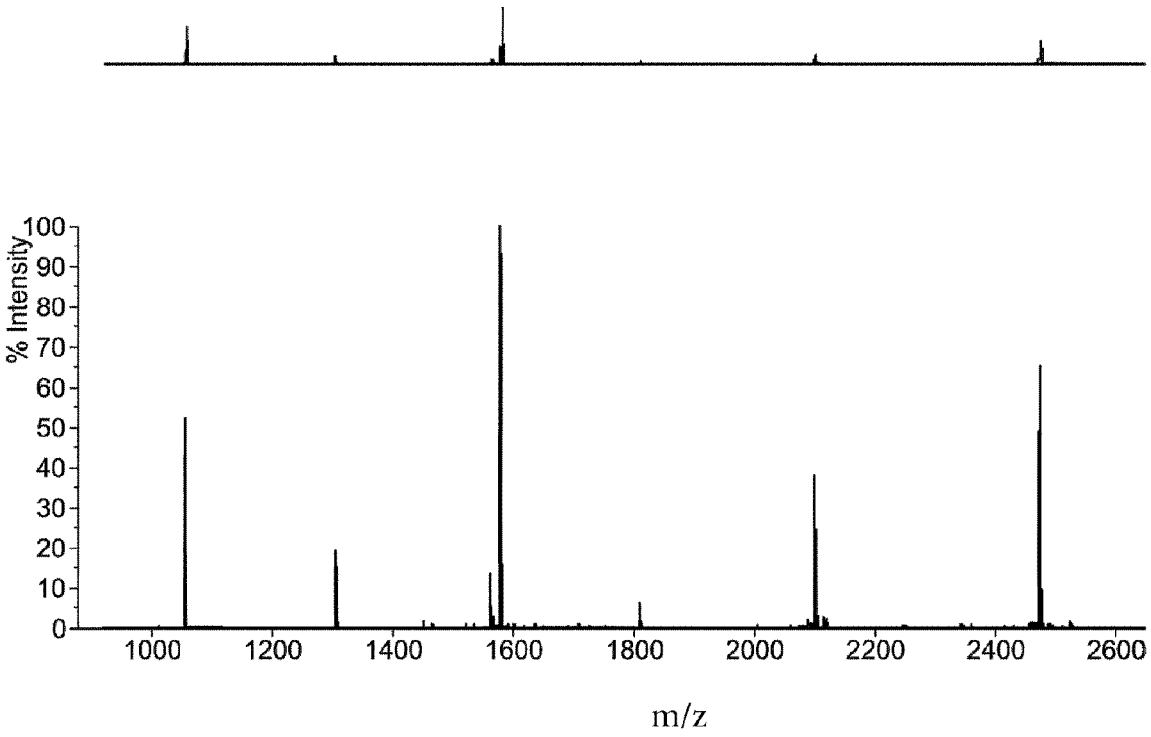
Figure 8B:
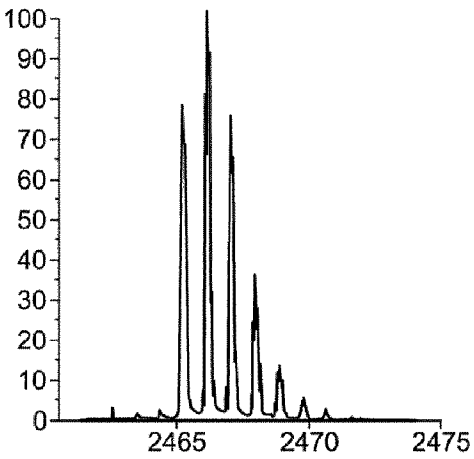

FIGS. 8(*a*) and 8(*b*) show a mass spectrum (normalised to maximum signal) of peptides in CHCA matrix obtained using a mass spectrometer having the ion source of FIG. 2: FIG. 8(*a*) with the ion optic axis aligned with the centre of the sample plate and FIG. 8(*b*) with the ion optic axis aligned with an extreme analysis point on sample plate.

Figures 9A, 9B:
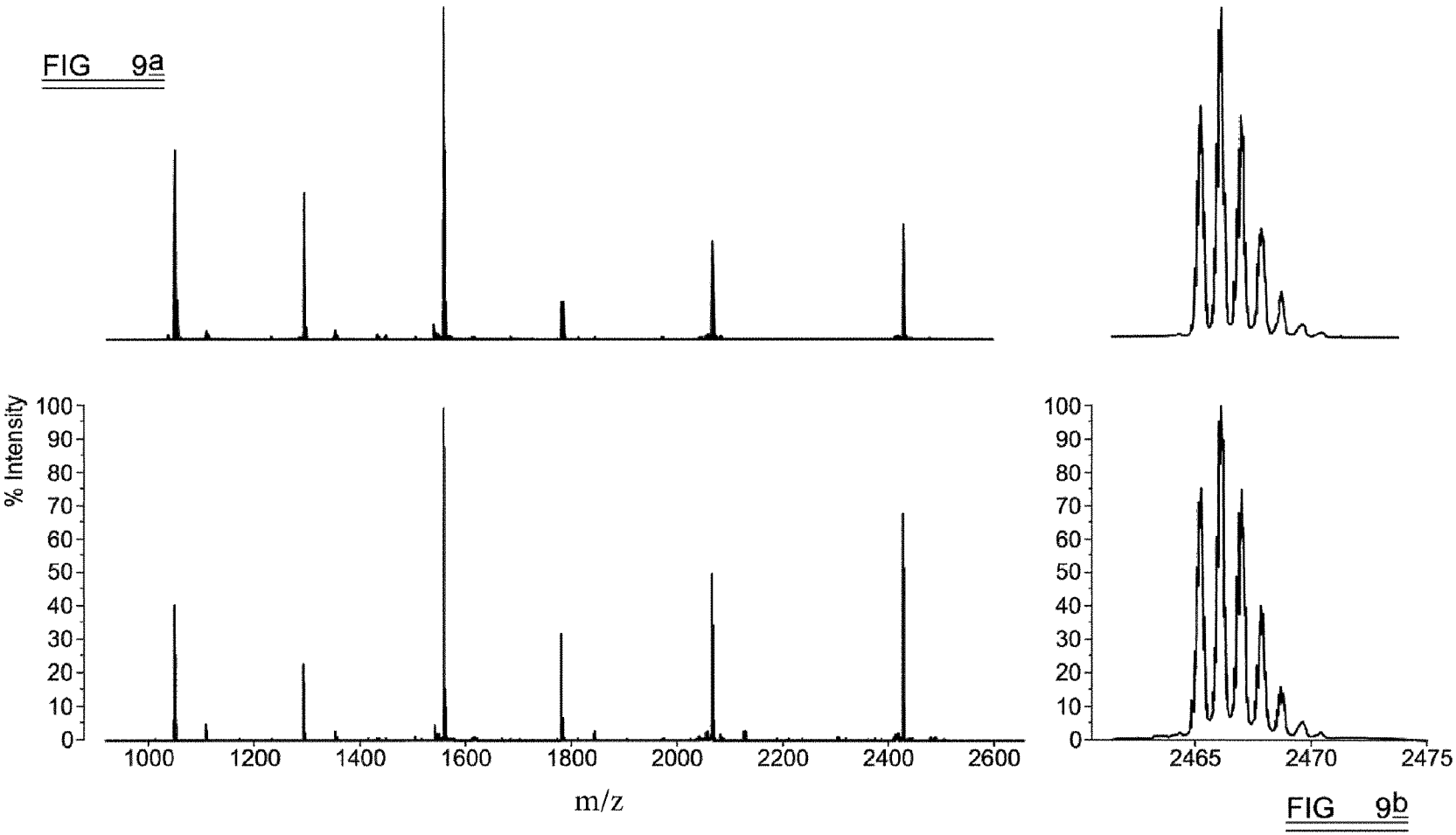

FIGS. 9(*a*) and 9(*b*) show a mass spectrum (normalised to maximum signal) of peptides in CHCA matrix obtained using a mass spectrometer having the ion source of FIG. 5(*b*): FIG. 9(*a*) with the ion optic axis aligned with the centre of the sample plate and FIG. 9(*b*) with the ion optic axis aligned with an extreme analysis point on sample plate.

In general, the following discussion describes examples of the present proposals in the context of a time of flight ("TOF") mass spectrometer including an ion source which has an extraction electrode located above a sample plate. In the example depicted, the extraction electrode is a plate-shaped element with an aperture formed therein, through which ions are extracted. The extraction electrode also has a shield formed thereon that extends towards a sample plate. The form of the shield is preferably optimised for the particular geometry of the extraction electrode to control side field penetration, preferably to ensure that pre- and post-extraction electric fields are axially symmetrical and invariant with sample plate carrier position (relative to the extraction electrode).

The present invention may be viewed as relating to an ion optic system for a time of flight (TOF) mass spectrometer.

Figure 1:
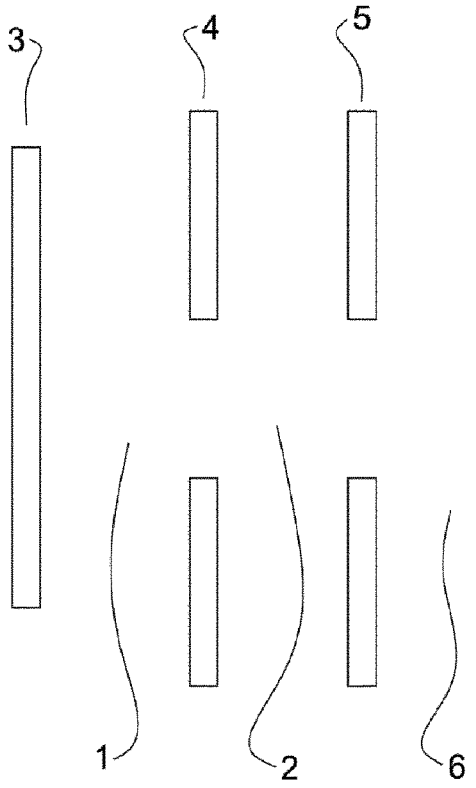
FIG. 1 shows an example TOF mass spectrometer that is not an embodiment of the present invention, but is useful for understanding the present invention.

As shown in FIG. 1, a TOF mass spectrometer typically comprises an extraction region 1, an acceleration region 2, a field free region 6 and associated TOF mass analyser (not shown). The mass analyser may be linear or reflectron, for example.

The extraction region is typically formed between a first electrode 3 and a second electrode 4. The acceleration region is typically formed between the second electrode 4 and a third electrode 5.

In a simple form, the second electrode 4 and third electrode 5 are planar parallel plates with appropriate size central apertures to enable the ions to pass through.

In a MALDI ion source, the first electrode 3 may be a sample plate. The MALDI process is often used to facilitate the vaporization and ionization of biomolecules and large organic molecules.

In a typical MALDI ion source, the molecules are embedded in a matrix which absorbs UV light. When a UV laser is fired on a sample, located on the sample plate 3, to initiate the MALDI process, a plume of ionised and neutral analyte and matrix molecules is ejected from the sample plate 3.

The ionised molecules are subsequently extracted from extraction region 1 through the aperture in the second electrode 4, often referred to as the extraction electrode, by applying appropriate voltages to the first and second electrodes 3, 4 to produce an extraction electric field in the extraction region 1. The ions are further accelerated by a field formed in the acceleration region 2 between the extraction electrode 4 and the third electrode 5. The third electrode may be at a ground potential with the ions passing through it into the field free region 6 of the mass spectrometer, e.g. to an associated linear or reflection mass analyser. For this reason, the third electrode 5 is often referred to as the ground electrode.

In a simple MALDI ion source, the ions may be promptly extracted by a static extraction electric field, of typically 2 to 5 kV, formed between the sample plate 3 and the extraction electrode 4 (for avoidance of any doubt, this field may be achieved by lowering an existing voltage applied to the extraction plate). The extracted ions pass may then pass through the aperture in the extraction electrode 4 and may then be further accelerated by a field formed in the accelerating region between the extraction electrode 4 and the ground electrode 5 before passing through the aperture in the ground electrode 5 into the field free region 6 and an associated mass analyser.

However, in many MALDI ion sources in TOF mass spectrometers, the ion source implements a technique known as pulsed extraction to improve the instruments mass resolution by focusing the kinetic energy spread of the ions. In such a technique, the resolution can be improved by holding the potential of the extraction electrode 4 at the same potential as the sample plate 3, creating a field free region, whilst ions are formed. Then, after a short predetermined delay, pulsing the extraction electrode 4, e.g. by between 2 kV and 5 kV, to produce the extraction electric field. The short delay may be chosen to be a period of time optimum for focusing the kinetic energy spread of the ions of interest. Essentially, with an appropriate delay, typically 10 ns to a few μs, ions with lower velocity are able to receive enough extra potential energy to catch ions with higher velocity after flying some distance from the ion source, usually the detector.

The electrodes 4, 5 used in the extraction and acceleration regions in a simple form may be plane parallel plates with a central aperture (the central aperture may be gridded or ungridded). The aperture in the extraction electrode 4 is usually fairly small, e.g. 2 mm to 20 mm, because once the size is increased beyond a few mm the electric field created by the potential difference between the extraction electrode 4 and the ground plate 5 extends through the aperture in the extraction electrode into the portion of the extraction region 1 immediately in front of the sample plate 3. This effect, which may be referred to as axial field penetration, may compromise the field free region in front of the sample plate 3 (prior to producing the extraction electric field, for pulsed extraction) and can therefore result in ions being extracted at an undesired time and/or having an undesired trajectory, which can significantly decrease both mass analyser resolution and mass analyser sensitivity. Therefore, it is usually desirable to maintain a small aperture.

However, there are advantages to having a larger aperture in the extraction electrode 4. For example, it may be desirable to be able to both direct the laser light beam into the ion source close to the ion optic axis and also view the sample plate 3 at an angle close to the ion optic axis, which both require a larger aperture diameter. Further, along with the charged analyte that is extracted through the ion lens, there is a great deal of neutral analyte and matrix ejected from sample that can rapidly contaminate elements of the extraction electrode 4 and may adversely affects the ion source performance. The rate at which this contamination builds up can be reduced with larger apertures.

It has been reported in U.S. Pat. No. 6,888,129 that axial field penetration can be controlled to an acceptable level with a larger aperture if the aperture in the extracting electrode is extended in the form of a through channel. FIG. 2 shows the TOF mass spectrometer of FIG. 1 modified to have a second electrode 7 whose aperture is extended in the form of a tube 11 that extends in the direction of the sample plate 3, such that the ions may pass through from one side of the second electrode 7 to the opposite side by passing through said channel. As taught in U.S. Pat. No. 6,888,129, the channel length may be slightly less than, equal to, or greater than the diameter of the aperture. As discussed in U.S. Pat. No. 6,888,129, the tube 11 helps to reduce the field penetration from the acceleration region 2 into the extraction region 1 through the aperture in the second electrode 7 to an acceptable level, without compromising the effectiveness of the pulsed extraction. In practice there will always be some residual field penetration through the extraction electrode 7 and a compromise must be achieved between the benefits of the larger aperture in the extraction electrode 7 and the detrimental effects on ion source performance. The tube 11 provided by the extended aperture proposed by U.S. Pat. No. 6,888,129 may be referred to as a secondary shield herein.

In a typical MALDI ion source, ions are produced from a small area on the sample plate 3, which area is typically no larger than the size of the beam waist of the irradiating laser light, typically 5 μm to 500 μm in diameter. In most practical applications it is required to analyse ions from several points on the same sample plate that may extend over several cm, or from several smaller samples arranged over an area of several cm. Typically the samples are arranged on a sample plate of rectangular form that may have a width that is in the range 20 mm to 150 mm (though other widths and forms are possible). It is possible to scan the laser beam (which may be UV light) over a stationary sample plate or move the sample plate relative to a fixed laser position. For most applications, it is more practical to translate the sample plate in a plane perpendicular to an ion optic axis. This is usually achieved by mounting the sample plate on a sample plate carrier, using a mechanism configured to translate the sample plate carrier laterally (e.g. in two orthogonal directions within a plane perpendicular to the ion optic axis).

FIG. 3(*a*) shows the extraction electrode 7 of FIG. 2 viewed along the ion optic axis with the aperture in the extraction electrode 7 aligned with the centre of the sample plate 3, i.e. with zero lateral offset.

FIG. 3(*b*) shows the extraction electrode 7 of FIG. 2 viewed along the ion optic axis when the sample plate carrier (and therefore the sample plate 3) is at a maximum permitted lateral offset with respect to the second electrode 7. Thus, ion optic axis which extends through the aperture in the extraction electrode 7 is aligned with an extreme measurement position in one corner of the sample plate 3.

With reference to FIGS. 3(*a*) and 3(*b*), the field formed between the sample plate 3 and extraction electrode 7 can be disturbed due to side field penetration between the sample plate 3 and the extraction electrode 4, as the sample plate carrier is translated from its zero offset (central alignment) position to a maximum lateral offset. This effect is more significant when there is not complete overlap between the extraction electrode 7 and sample plate 3.

This effect is illustrated by FIGS. 4(*a*) and 4(*b*), which show field contours, on electrostatic model of the ion source of FIG. 2, in a region around the sample plate 3 and the extraction electrode 7. As can be seen from FIGS. 4(*a*) and 4(*b*), the field is symmetrical when the sample plate 3 is centred on the axis of the extraction electrode 7 (zero lateral offset), but asymmetrical when the sample plate 3 is laterally offset with respect to the extraction electrode 7.

The side field penetration between the sample plate 3 and extraction electrode 7 is potentially more problematic than axial field penetration, described above, due to its asymmetry and variation with sample plate carrier position.

The effect of the side field penetration can be significant before and during production of the pulsed extraction field between the sample plate 3 and the extraction electrode 7. Ideally, the region of initial ion formation in the extraction region 1 would be completely free of any side field penetration effects formed between edges of the extraction electrode 7 and the sample plate 3 (/sample plate carrier). Ideally, this field free region would extend to the distance traveled by the fastest moving (e.g. lowest mass) ions of interest during the period of time prior to the extraction field being formed (i.e. the pre-extraction period). Otherwise the effects of non-axisymmetric electric penetration could cause axial spreading of the ions, leading to loss of resolution, and divergence and deviation of the ions leading to loss of sensitivity.

During pulsed extraction, side field penetration may distort the lens formed by the electric field between the sample plate 3 and the extraction electrode 7. This could adversely influence a focusing effect, which could in turn cause undesirable aberrations, again leading to loss of resolution and loss of sensitivity. Similar problems would also occur for an ion source configured to produce a static extraction electric field that is present during both the formation and extraction of ions.

Uncontrolled and varying side field penetration as the sample plate 3 is translated, can therefore distort potentials between the sample plate 3 and extraction electrode 7 during pre-extraction and the pulsed extraction periods. Such uncontrolled and distorted potentials in the ion beam path may give rise to significant differences in both mass analyser resolution and mass analyser sensitivity as the sample plate carrier position varies.

The following examples aim to reduce the penetration of side fields to areas traversed by ions so as to reduce variation (preferably such that that there is no significant change in) instrument performance as the sample plate is laterally offset with respect to second electrode 7 (/ion optic axis), as well as to improve the quality of the mass spectra obtained (preferably so that the quality of mass spectra obtained is invariant with sample position on the sample plate 3).

Accordingly, with reference to FIG. 5(*a*), there is provided a TOF mass spectrometer in which an ion source has an extraction electrode 9. The extraction electrode 9 is a plate-shaped element having an aperture formed therein. A shield 10, which is a raised element, is formed on a surface of the extraction electrode 9 that faces the sample plate 3 so that the shield 10 extends towards the sample plate 3. The shield 10 surrounds an ion optic axis that extends through the aperture. The shield 10 is outwardly spaced apart from a boundary 10*a* between the extraction electrode 9 and the aperture. In this way, the shield 10 helps to inhibit an electric field formed between edges of the sample plate 3 and extraction electrode 4 from penetrating into the extraction region 1. In turn, this helps to shield the extraction region 1 (specifically the portion of the extraction region 1 where ions are present when the mass spectrometer is in use) from changes in the side penetration fields as the sample plate carrier (and therefore the sample plate 3) is translated with respect to the second electrode 9 (/ion optic axis).

The shield 10 of the extraction electrode 9 thereby helps to prevent significant changes in the pre-extraction and pulse extraction fields, thus helping to maintaining mass analyser resolution and mass analyser sensitivity as the sample plate carrier (and therefore the sample plate 3) position varies.

The shield 10 can be incorporated both as part of an extraction electrode 9 that incorporates a plane aperture (no secondary shield), not extending beyond the planar surfaces of the electrode as shown in FIG. 5(*a*), or as part of an extraction electrode 9' that incorporates an aperture extending beyond the planar surfaces of the electrode to provide a through element in form of a tube 11' as shown in FIG. 5 (*b*).

The tube 11' of FIG. 5(*b*) may be referred to as a secondary shield herein. Here, the secondary shield is configured to inhibit an electric field from penetrating into the extraction region 1 through the aperture formed in the extraction electrode 9'.

The preferred form of the shield 10 is circular, being provided here as an annular ring, concentric with the aperture in the extraction electrode 9. However, in practice the shield does not have to be circular, but could be square, rectangular or have another form.

Parameters defining the shield may include its height (above the surface of the extraction electrode 9 that faces the sample plate 3) and, if the shield is circular, its inner radius and outer radius. These parameters are not completely independent of each other and are preferably within certain bounds for the shield to be effective. It is highly preferably for the shield 10 to be of such a form to prevent side field penetration into the portion of the extraction region 1 where ions are present when the mass spectrometer is in use up to a maximum lateral offset of the sample plate carrier (and therefore the sample plate 3), but without significantly distorting the shape of the extraction electric field used for focusing ions during pulsed extraction.

In general, the inner radius of the shield 10 may be determined by the size and shape of the sample plate 3/sample plate carrier and the height of the shield 10 and outer radius may be optimised to control the side field penetration within other instrument constraints.

The inner radius of the shield is preferably such that when the sample plate at a maximum permitted lateral offset, the inwardly facing surface of the shield 10 is within the boundary of the sample plate carrier (when viewed along the ion optic axis). This is because if the inwardly facing surface of the shield 10 is outside this boundary (when viewed along the ion optic axis), the side fields will readily penetrate into the extraction region. Lower values for the inner radius could be used and may be desirable to define the shape of the lens formed by the extraction electric field produced between the sample plate 3 and extraction electrode 9, the requirements for which depend greatly on the particular ion source geometry, for example, whether the extraction electrode 9 has a plane aperture as in FIG. 5(*a*) or tube 11' as in FIG. 5(*b*).

In the above paragraph, it has been assumed that the sample plate carrier is conductive and therefore forms the first electrode together with the sample plate 3, and that the sample plate carrier provides the outer boundary of the first electrode. However, this need not be the case in other examples.

The outer radius and the height of the shield may be optimised to control the side field penetration. Generally, within limits, a wider low shield has similar effectiveness as a higher narrow shield. The limits for the outer radius and height of the shield 10, 10' may therefore be determined by particular ion source geometry.

The height of the shield 10, 10' is preferably such that there is a clearance between the shield 10, 10' and the sample plate 3 of at least 2 mm, so as to avoid electrical breakdown between the sample plate 3 and extraction electrode 4, which may typically have a potential difference of up to between 2 kV and 5 kV across them. There may also be other practical considerations that impose a minimum clearance between the shield 10, 10' and the sample plate 3 that relate to the mechanism used to translate the sample plate carrier (and therefore sample plate 3). Further, MALDI mass spectrometers often incorporate a viewing system to enable imaging of the sample, the illumination for which is preferably directed at a low angle of incidence with respect to the sample plate 3, which may requires a clearance of a few mm between the shield 10, 10' and the sample plate 3, depending on the particular illumination system employed.

Some preferred limits and values for the parameters discussed above are shown in FIG. 6, in which the extraction electrode 9 is assumed to have a tube 11' aperture. In this example: the height of the shield is bound by the height of the tube 11' and a 2 mm clearance with sample plate 3; the maximum inner radius of the shield is defined by the preferred requirement (discussed above) for the inwardly facing surface of the shield to remain within the outer boundary of the sample plate carrier when the sample plate carrier is at a maximum permitted lateral offset with respect to the second electrode; the minimum inner radius of the shield can be optimised to control ion optic lensing in the extraction region; the maximum outer radius of shield is defined by the outer radius of the extraction electrode; the minimum outer radius of the shield can be optimised to control side field penetration for a given shield height. Thus, any combination of shield defining parameters within the hatched area of FIG. 6 may be preferred to control the side field penetration, but the most preferred values are defined by the solid line within hatched area of FIG. 6. This line defines the combinations of shield defining parameters, established by electrostatic modelling, that minimise the side field penetration into the region of ion formation and extraction within the extraction region. This line is of course specific to the ion source design shown here as example and similar analysis would be required to define parameters to achieve optimum field penetration control for other ion source geometries.

The plot of FIG. 6 plots minimum outer radius against height, and was produced by adjusting height and then calculating the optimum minimum outer radius for that height (having optimised for other parameters).

FIGS. 7(*a*) and 7(*b*) show field contours, on electrostatic model of an ion source incorporating the extraction electrode 9' of FIG. 5(*b*) in a region around sample plate 3 and the extraction electrode 9'. As shown in this drafting, the field is symmetrical BOTH when the sample plate 3 is centred on the extraction electrode axis and when the sample plate 3 is laterally offset with respect to the extraction electrode 9'. This insensitivity to sample plate position is directly due to the shield preventing side field penetration into extraction region.

FIGS. 8(*a*) and 8(*b*) show a mass spectrum of peptides in the range 1-5 kDa, obtained experimentally using a mass spectrometer having an ion source that includes the extraction electrode 7 of FIG. 2 (with tube 11, but lacking shield 10), where the mass spectrometer was optimised/tuned with a sample located at centre of sample plate.

FIGS. 8 (*a*) and 8(*b*) show spectra obtained from centre and corner of the sample plate, respectively. As can be seen from FIGS. 8(*a*) and 8(*b*), the amplitude of signal obtained at corner of sample plate has suffered a loss in intensity of approximately 90% with respect to amplitude at centre of sample plate.

FIGS. 9(*a*) and 9(*b*) show a mass spectrum of the same peptides obtained experimentally using a mass spectrometer having an ion source that includes the extraction electrode 9' (with tube 11', with shield 10'), where the mass spectrometer was again optimised/tuned with sample located at centre of sample plate. FIGS. 9 (*a*) and 9(*b*) show spectra obtained from centre and corner of plate, respectively. As can be seen from FIGS. 9(*a*) and 9(*b*), the amplitude of signal obtained at corner of sample plate this time can be seen not to have suffered any significant loss in intensity or skewing of intensity distribution with respect to amplitude at centre of sample plate.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For example, although the examples depicted herein show the shield formed on the extraction electrode of an ion source, the shield could equally be applied to the sample plate of the ion source.

Moreover, although the examples depicted herein show the proposed shield as applied to the sample plate and extraction electrode of an ion source, it should be appreciated that the same principles could be applied to any electrode pair in a TOF mass spectrometer where voltages are applied to produce an electric field in a region between the first and second electrodes so as to influence (e.g. accelerate, decelerate, influence trajectory of, focus, defocus) ions present in the region between the first and second electrodes when the mass spectrometer is in use.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The invention claimed is:

1. A time of flight mass spectrometer, comprising:

an ion source including:

a first electrode, wherein the first electrode includes a sample plate for carrying a sample; and a second electrode that has an aperture formed therein and is spaced apart from the first electrode;

a sample plate carrier on which the sample is mounted; and a mechanism configured to translate the sample plate carrier laterally with respect to an ion optic axis so as to laterally offset the sample plate carrier with respect to the ion optic axis, wherein the ion optic axis extends between the first and second electrodes and through the aperture in the second electrode;

wherein the ion source is configured to apply voltages to the first and second electrodes to produce an extraction electric field in an extraction region between the first and second electrodes so as to extract ions from the extraction region through the aperture in the second electrode when the mass spectrometer is in use;

wherein a shield is formed on the first electrode and/or second electrode, wherein the shield is a raised element formed on a surface of one of the first and second electrodes that faces the other of the first and second electrodes so that the shield extends towards the other of the first and second electrodes, wherein the shield is configured to inhibit an electric field formed between edges of the first and second electrodes from penetrating into the extraction region between the first and second electrodes so as to inhibit changes in the extraction electric field in the extraction region when the sample plate is laterally offset with respect to the ion optic axis when the mass spectrometer is in use.

2. A time of flight mass spectrometer according to claim 1, wherein the shield surrounds an axis extending between the first and second electrodes.

3. A time of flight mass spectrometer according to claim 1, wherein the first electrode includes an aperture formed therein.

4. A time of flight mass spectrometer according to claim 1, wherein an inwardly facing surface of the shield is outwardly spaced apart from an axis extending between the first and second electrodes by a distance that is at least the width of the aperture formed in the second electrode.

5. A time of flight mass spectrometer according to claim 1, wherein an outwardly facing surface of the shield is outwardly spaced apart from an axis extending between the first and second electrodes by a distance that is at least 1.5 times the width of the aperture formed in the second electrode.

6. A time of flight mass spectrometer according to claim 1, wherein the shield is formed on the second electrode, and a secondary shield is formed on the second electrode, wherein the secondary shield is configured to inhibit electric field from penetrating into the region between the first and second electrodes through the aperture formed in the second electrode, wherein the secondary shield surrounds the aperture.

7. A time of flight mass spectrometer according to claim 6, wherein the height of the shield is larger than the height of the secondary shield.

8. A time of flight mass spectrometer according to claim 1, wherein the shield is formed on the second electrode and an inwardly facing surface of the shield is outwardly spaced from a boundary between the second electrode and the aperture formed in the second electrode by a distance that is adequately small so that the inwardly facing surface of the shield remains within the outer boundary of the first electrode when viewed along an ion optic axis, when a centre of the sample plate carrier is at a maximum permitted lateral offset with respect to the ion optic axis.

9. A time of flight mass spectrometer according to claim 1, wherein the ion source includes a laser for ionising a sample carried on the sample plate by firing light at the sample.

10. A time of flight mass spectrometer according to claim 1, wherein the ion source is a MALDI ion source.

* * * * *